US005865880A

United States Patent [19]

Matsui

[11] Patent Number: 5,865,880

[45] Date of Patent: Feb. 2, 1999

[54] AIR CLEANING SYSTEM HAVING FORCED NEGATIVE PRESSURE GENERATING FUNCTION

[75] Inventor: Shigeo Matsui, Tokyo, Japan

[73] Assignee: Tornex, Inc., Tokyo, Japan

[21] Appl. No.: 712,176

[22] Filed: Sep. 11, 1996

[30] Foreign Application Priority Data

Sep. 14, 1995 [KR] Rep. of Korea ..... 1995-29943

[51] Int. Cl.[6] ..... B03C 3/72

[52] U.S. Cl. ..... 96/26; 55/467; 55/485; 55/486; 55/DIG. 29; 96/58; 96/63

[58] Field of Search ..... 55/274, 467, 385.1, 55/385.2, 471, 485, 486, 279, DIG. 29, DIG. 35, DIG. 36; 96/26, 55, 57, 58, 63; 454/188–193; 95/57, 78, 273, 286, 287

[56] References Cited

U.S. PATENT DOCUMENTS

| | | | |
|---|---|---|---|
| 2,767,804 | 10/1956 | Foley | 96/26 X |
| 2,990,911 | 7/1961 | Lippincott | 96/26 |
| 3,011,230 | 12/1961 | Potapenko | 55/DIG. 29 |
| 3,986,850 | 10/1976 | Wilcox | 55/DIG. 29 |
| 4,318,152 | 3/1982 | Weber | 96/26 X |
| 4,427,427 | 1/1984 | DeVecchi | 55/DIG. 29 |
| 4,854,949 | 8/1989 | Giles, Sr. et al. | 96/58 |
| 4,902,316 | 2/1990 | Giles, Sr. et al. | 96/58 |
| 4,927,438 | 5/1990 | Mears et al. | 55/DIG. 29 |
| 5,264,015 | 11/1993 | Matsui | 55/467 |

*Primary Examiner*—Richard L. Chiesa
*Attorney, Agent, or Firm*—Bauer & Schaffer

[57] ABSTRACT

An air cleaning system having a forced negative pressure generating function is provided for defining a space in a room for utilizing the space as a smoking area or the like in which contaminated air such as smoke is prevented from flowing out of the space and is cleaned. The air cleaning system having a forced negative pressure generating function has an air curtain producing unit having a blow-out port for producing air curtains to surround a predetermined space, an air sucking unit having a suction port open to the predetermined space defined by the air curtains for sucking air in the predetermined space, an air exhausting unit having an exhaust port open to the outside of the predetermined space for exhausting air sucked by the air sucking means to the outside of the predetermined space, an air cleaner unit interposed between the exhaust port and the suction port, and an air cleaner body supported by a plurality of stems for accommodating the components. An amount of air exhausted from the exhausted port is set larger than an amount of air externally involved by the air curtains from the outside of the predetermined space to produce a negative pressure in the predetermined space defined by the air curtains. In this way, the negative pressure in the predetermined space prevents contaminated air such as smoke from leaking therefrom, and the air cleaner unit cleans such contaminated air before it is exhausted from the predetermined space.

7 Claims, 9 Drawing Sheets

AIR CLEANING SYSTEM HAVING FORCED NEGATIVE PRESSURE GENERATING FUNCTION

BACKGROUND OF THE INVENTION

1. Field of the Invention

The present invention relates to an air cleaning system, and more particularly to an air cleaning system having a forced negative pressure generating function which may be installed in a room or the like for forming an air curtain to define a predetermined space in part of the room, such that the predetermined area may be utilized as a smoking area or the like to prevent malodorous and harmful smoke from diffusing out of the predetermined space.

2. Description of the Related Art

Conventionally, partitions have been often used to surround part of a room to utilize the space defined by the partition walls as a smoking area or a tea drinking area. The partitions, however, are intended to surround a space within a relatively large room, so that air may freely come in and out the surrounded space through open areas between the upper edges of the partitions and the ceiling or between the lower edges of the partitions and the floor. Thus, contaminated air (smoke, exhaust gas, harmful gas) and bad smell possibly produced in the surrounded space may flow out to cause the contamination in the entire room.

For preventing this inconvenience, a partition having a built-in air curtain producing system, as illustrated in FIGS. 1 and 2 has been proposed. Specifically explaining, the illustrated partition a has a built-in air fan b, an air blow-out port c on the top for forming an air curtain, and an air suction port d on a lower side portion. Several units of the partitions a are placed in combination on a floor h to surround a portion of a room with their suction ports d directed to the inside of the surrounded space. A suction fan f is also installed in the ceiling e above the portion of the room surrounded by the partitions a. The air fans b are operated to blow air from the blow-out ports c to form air curtains q such that a predetermined space i is surrounded together with the floor h, ceiling e, and partitions a. Then, air within the predetermined space i is exhausted by the suction fans f out of the space i to produce a negative pressure therein, such that contaminated air, bad smell and so on possibly produced within the space i are prevented from diffusing throughout the room.

However, even if the prior art air curtain producing system allows a portion of a room to be simply surrounded by the partitions a for use as a smoking area or a tea drinking area, the suction fan f, the installation of a duct for exhausting contaminated air and bad smell, and an associated piping system are required in the ceiling e and other external places. Thus, available places are limited, and the entire system cannot be readily installed in any desired place.

Further, since the predetermined space i surrounded by the air curtains a must be always maintained at a negative pressure in order to prevent contaminated air and bad smell in the predetermined space i from flowing therefrom, the suction fan f must exhaust an amount of air larger than the amount of air involved by the air curtain q from the outside of the predetermined space i. Such a large amount of exhaust air would adversely affect air conditioning facilities of the entire building.

To solve the above-mentioned problem, the present inventor has proposed a screen having an air cleaning function, as illustrated in FIG. 3, in U.S. Pat. No. 5,264,015. In a predetermined space i surrounded by the screens, the air flow amount sucked by a fan f is larger than an air amount externally involved by an air curtain q from the outside of the space i, thus maintaining a negative pressure within the space i, and air sucked by the fan f is cleaned by a built-in air cleaner and discharged to the outside. This screen having an air cleaning function advantageously surrounds part of a room for readily providing a place serving as a smoking area or a tea drinking area without exerting any influence on an air conditioning facility of the room such as cooling, heating, and so on. However, since a plurality of screens are installed in a room, the entire layout of the room must be taken into consideration. Also, since the screens define a place together with part of the ceiling and part of the floor of a room, the screens cannot be effectively utilized in a room having a high ceiling. In addition, the screens, when installed in a room, will obstruct the view in the room.

OBJECTS AND SUMMARY OF THE INVENTION

In view of the problems mentioned above, it is an object of the present invention to provide an air cleaning system having a forced negative pressure generating function which does not require the installation of a suction fan, duct, piping system, and so on in the ceiling of a room, and is capable of maintaining a predetermined space defined in a portion of the room at a stable negative pressure without affecting air conditioning facilities to prevent contaminated air from flowing out from the predetermined space and to clean the contaminated air before it is exhausted from the predetermined space.

It is another object of the present invention to provide an air cleaning system having a forced negative pressure generating function which is easy to install in any room for preserving a portion thereof for any particular purpose, even if the room has a high ceiling.

It is a further object of the present invention to provide an air cleaning system having a forced negative pressure generating function which is capable of defining a space in a room without obstructing the view in the room.

To achieve the above objects, the present invention provides an air cleaning system having a forced negative pressure generating function comprising air curtain producing means having a blow-out port for producing air curtains to surround a predetermined space, air sucking means having a suction port open to the predetermined space defined by the air curtains for sucking air in the predetermined space, air exhausting means having an exhaust port open to the outside of the predetermined space for exhausting air sucked by the air sucking means to the outside of the predetermined space, air cleaning means interposed between the exhaust port and the suction port, and an air cleaner body supported by a plurality of stems for accommodating the air curtain producing means, the air sucking means, the air exhausting means, and the air cleaning means, wherein an amount of air exhausted from the exhausted port is set larger than an amount of air externally involved by the air curtains from the outside of the predetermined space to produce a negative pressure in the predetermined space defined by the air curtains.

The above and other objects, features and advantages of the present invention will become more apparent from the following detailed description of the preferred embodiment when read in conjunction with the accompanying drawings.

DESCRIPTION OF THE PREFERRED EMBODIMENTS

The present invention will hereinafter be described in connection with several embodiments thereof with reference to FIGS. 4–19.

Figure 1:
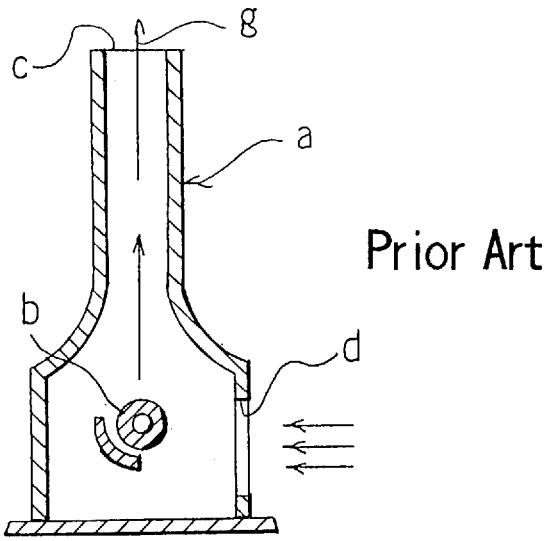
FIG. 1 is a cross-sectional view schematically illustrating the construction of a partition in a prior art air curtain producing system.
Figure 2:
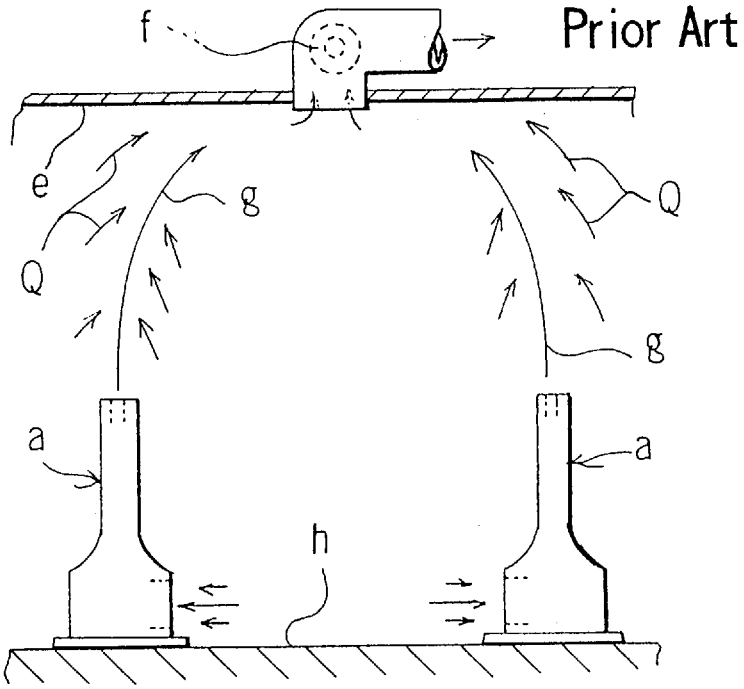
FIG. 2 is a lateral view illustrating the whole arrangement of the prior art air curtain producing system.
Figure 3:
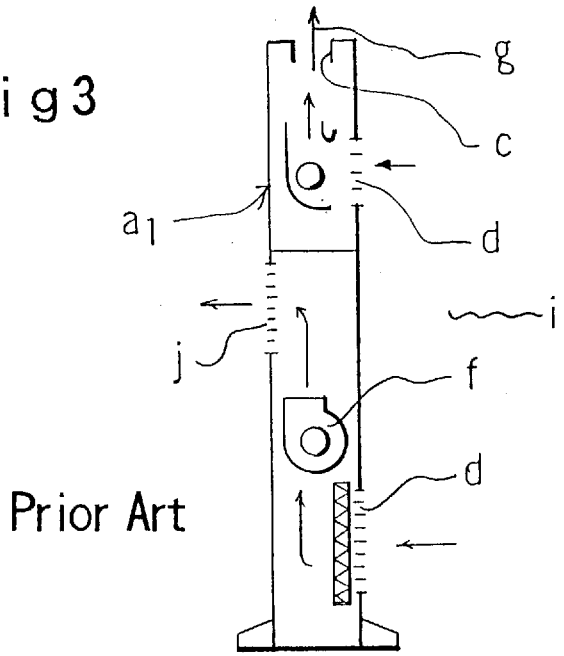
FIG. 3 is a lateral view illustrating the construction of a prior art screen having an air cleaning function.
Figure 4:
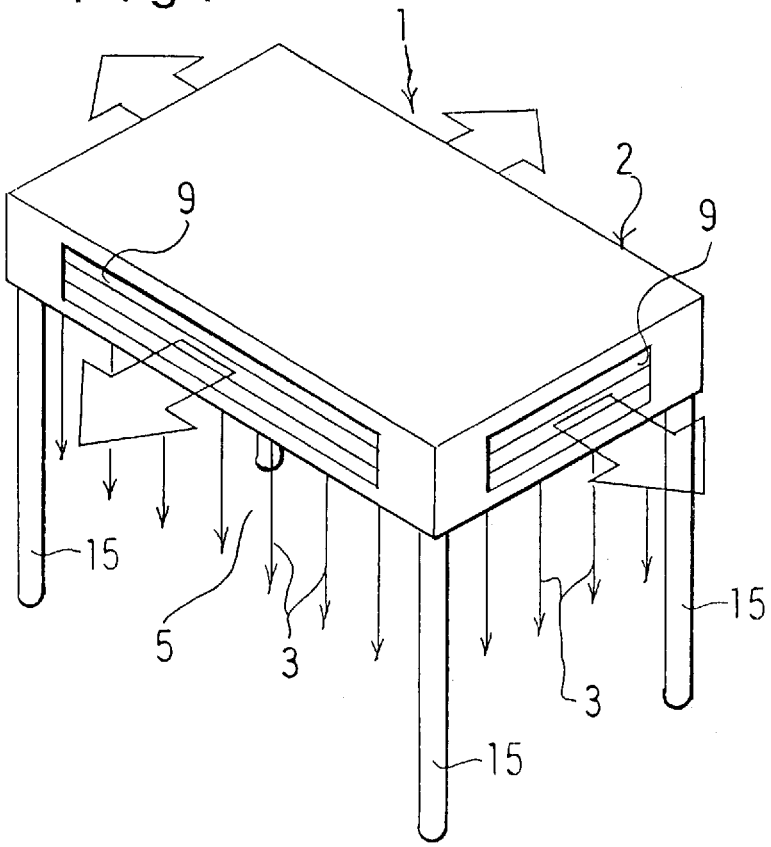
Prior Art Fig4
FIG. 4 is a perspective view illustrating a first embodiment of an air cleaning system having a forced negative pressure generating function according to the present invention.
Figure 5:
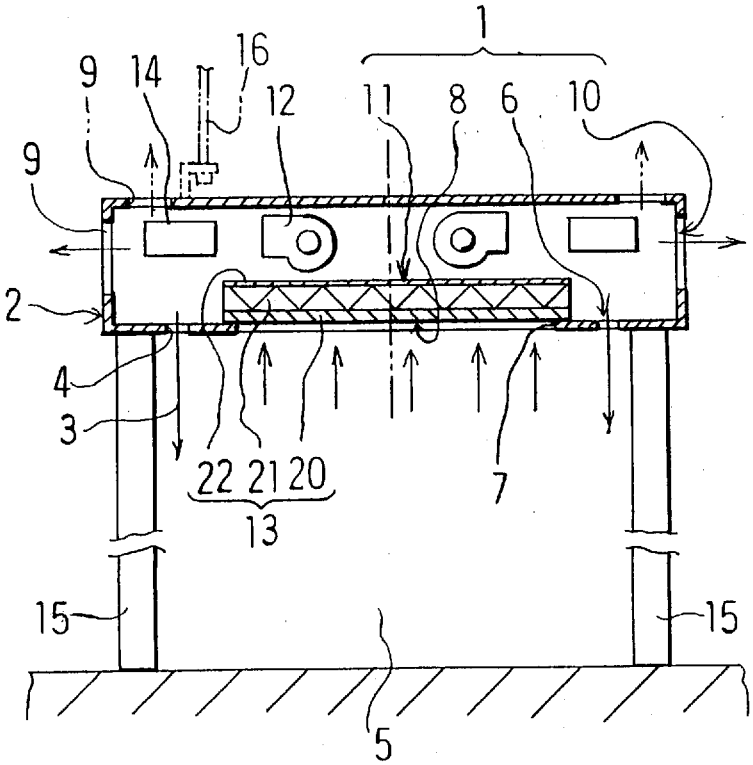
FIG. 5 is a cross-sectional view of the first embodiment illustrated in FIG. 4.
Figure 6:
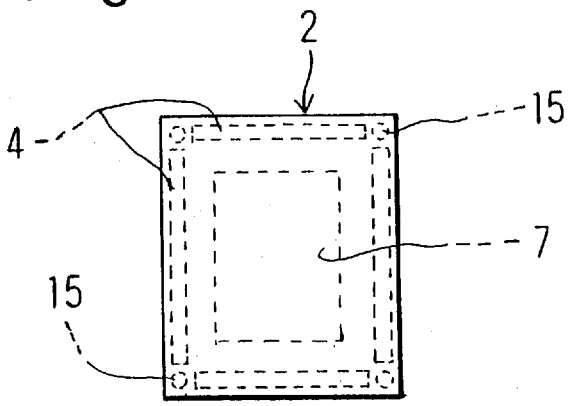
FIG. 6 is a top plan view illustrating the air cleaning system having a forced negative pressure generating function when installed in a room.

Referring first to FIGS. 4–6, illustrating a first embodiment of the present invention, an air cleaning system 1 having a forced negative pressure generating function is incorporated in a cleaner body 2 having an outer appearance of a roof. Specifically, the air cleaning system 1 comprises an air curtain producing unit 6 having four blow-out ports 4 for forming air curtains 3 as a means for surrounding a predetermined space 5, an air suction unit 8 having a suction portion 7 directed to the predetermined space 5 surrounded by the air curtains 3, an air exhaust unit 10 having an exhaust port 9 directed to the outside of the predetermined space 5 for exhausting air sucked by the air suction unit 8, and an air cleaner unit 11 arranged at least between the exhaust port 9 and the suction port 7. The air curtain producing unit 6 is positioned such that the air curtains 3 from the blow-out ports 4 surround the predetermined space 5, and an amount of air exhausted from the exhaust port 9 is made larger than an amount Q of air involved by the air curtain 3 from the outside, whereby a negative pressure is produced within the predetermined space 5.

The air curtain producing unit 6, air suction unit 8, air exhaust unit 10, and air cleaner unit 11 are integrally disposed in the cleaner body 2. An air fan 12 is also disposed in the cleaner body 2. The air curtain producing unit 6 is constructed by connecting the discharge side of the air fan 12 to the blow-out port 4, the air suction unit 8 is constructed by connecting the suction side of the air fan 12 to the suction port 7, the air exhaust unit 10 is constructed by connecting the discharge side of the air fan 12 to the exhaust port 9, and the air cleaner unit 11 is constructed by disposing an air cleaner 13 between the suction side of the air fan 12 and the suction port 7. The air cleaning system 1 having a forced negative pressure generating function is provided with an air amount adjusting mechanism 14 disposed adjacent to the discharge side of the air fan 12, blow-out port 4 and exhaust port 9 for ensuring that an amount of air exhausted from the exhaust port 9 is set larger than the amount Q of air involved by the air curtain 3 from the outside, in order to forcedly maintain the predetermined space 5 in a negative pressure state.

The cleaner body 2, having an appearance of a roof as mentioned above, is provided with supporting stems 15 for facilitating the formation of the predetermined space 5 in the room. The height, length, and width of the cleaner body 2 may be varied for respective specific applications. Alternatively, the cleaner body 2 may be suspended from the ceiling by suspender cables 16 as illustrated in FIG. 5.

The blow-out port 4 is not limited to any specific shape as long as the air curtain 3 can be formed thereby. For example, the blow-out port 4 may be formed of an elongated rectangular hole, a plurality of circular holes, or a plurality of nozzles. It should be noted that the blow-out port 4 formed of nozzles conveniently allows an air blowing direction to be easily changed.

Contaminated air within the predetermined space 5 is sucked by the air fan 12 from the suction port 7, and cleaned by the air cleaner 13. Part of the cleaned air is blown from the blow-out port 4 to form an air curtain 3 having a set length, while the rest of the cleaned air, which is set larger than the amount Q of air involved by the air curtain 3 from the outside of the predetermined space 5, is exhausted from the exhaust port 9, whereby the predetermined space 5 is maintained in a negative pressure state.

The air amount $Q_F$ of the air fan 12 is calculated by the following equations:

$$Q_t=0.55(H/W_0)^{1/2}Q_0 \quad (1)$$

$$Q=\tfrac{1}{2}\cdot(Q_t-Q_0) \quad (2)$$

Thus, $$Q_F=(Q_0+Q)\alpha \quad (3)$$

where $Q_F$: Total amount of the air curtain and air involved by the air curtain [$m^3$/min];

H: Distance from the ceiling to the flour [m];

$W_0$: Width of the air curtain blow-out port [m];

$Q_0$: Amount of air blown as the air curtain [$m^3$/min];

Q: Amount of air involved from the outside [$m^3$/min];

$\alpha$: Safety factor.

It should be noted that the type of the air fan 12 is not limited to any particular one.

Although not particularly limited, the air cleaner 13 of this embodiment includes a prefilter 20 for filtering out relatively large particles in contaminated air, an electrical precipitator 21 for removing fine particles, and a deodorizing filter 22 for removing odor components in the air. The prefilter 20, electric dust precipitator 21 and deodorizing filter 22 are positioned in this order from the suction port 9 side in the cleaner body 2. With this construction, the air cleaner 13 has a higher cleaning capability and a longer life than an air cleaner of a type which only passes contaminated air through a single air cleaning filter for removing all contamination components at one time.

The electric dust precipitator 21 has a built-in program which turns off the power supply to the electric dust precipitator 21 for a predetermined time period, for example, ten seconds when its electrodes are short-circuited and generates an alarm when the short-circuiting occurs a predetermined number of times within a predetermined time period, for example, ten times within one hour. With this performance, if foreign particles having relatively large diameters such as ash enter into the electric dust precipitator 21 to cause short-circuiting between the electrodes, the power supply is turned off. Therefore, crisp noise caused by the short-circuiting is soon stopped, and the relatively large foreign particles are passed through the electrodes in the meantime, so that crisp noise will not be again generated when the power supply is turned on after the predetermined time period. Further, since the occurrence of continuous short-circuiting between the electrodes causes the alarm to be generated, appropriate measures can be taken in response to the alarm.

Alternatively, the electric dust precipitator 21 may have a different program which decreases a discharge voltage for a predetermined time period when the electrodes are short-circuited and generates an alarm when the short-circuiting occurs a predetermined number of times within a predetermined time period. This alternative program is advantageous over the first program because the discharge voltage is decreased to reduce crisp noise to such a degree that humans cannot hear when short-circuiting occurs, and contaminated air can be continuously collected in the meantime.

The air amount adjusting mechanism 14, also not limited to any particular type, is implemented by a damper in this embodiment.

Next, the air cleaning system 1 having a forced negative pressure generating function constructed as described above will be explained in terms of its operation.

First, the cleaner body 2 of a size suitable for the shape and dimension of a room in which they are installed is selected, and a required number of the selected cleaner bodies 2 are prepared. In an example illustrated in FIG. 6, one cleaner body 2 is installed. First, the air fan 12 is operated, and the air amount adjusting mechanism 14 is actuated to adjust the amounts of air through the respective blow-out ports 4 and exhaust ports 9 to satisfy the above-mentioned equations. Thus, when the air fan 12 is started with this configuration, contaminated air within the predetermined space 5 is sucked from the suction port 7, cleaned by the air cleaner 13 and partially blown out from the blow-out ports 4 to form the air curtains 3. The air curtains 3 thus formed surround a portion of the room to form a predetermined space 5, and the air forming the air curtains 3 circulates. The air curtains 3 involve air from the outside of the predetermined space 5, so that an amount of circulating air increases.

The rest of the cleaned air is exhausted from the exhaust ports 9 facing the outside of the predetermined space 5. Since the amount of exhausted air is set larger than the amount Q of externally involved air, the predetermined space 5 is maintained at a negative pressure. Thus, even if a person smokes a cigarette within the predetermined space 5 maintained at a negative pressure, the smoke is sucked into the suction port 7 without leaking from the predetermined space 5, cleaned by the air cleaner 13, and exhausted to the outside of the predetermined space 5 as cleaned air.

Also, in this event, if relatively large foreign substances such as cigarette ash enter the electric dust precipitator 21 to cause short circuiting between the electrodes, the electric dust precipitator 21 is immediately turned off or a discharge voltage is reduced, depending on the program employed for the purpose, so that crisp noise is immediately stopped or reduced. Then, the electric dust precipitator 21 is again turned on after a predetermined time period, or the discharge voltage is increased to a normal value to resume the collection of fine particles. If short-circuiting occurs many times, an alarm is generated, so that appropriate measures may be taken in response to the alarm.

As described above, according to the first embodiment of the air cleaning system 1 having a forced negative pressure generating function of the present invention, it is possible to set a wind velocity for forming air curtains of a length suitable for a particular application by adjusting the air amount adjusting mechanism 14. In addition, the specific space 5 can be maintained in a stable negative pressure state. Thus, even if people smoke within the predetermined space 5, smoke is cleaned by the air cleaner 13 without leaking to the outside of the predetermined space 5, so that the entire room can be free from the contamination due to the smoke, thus maintaining a favorable environment in the entire room.

Figure 7:
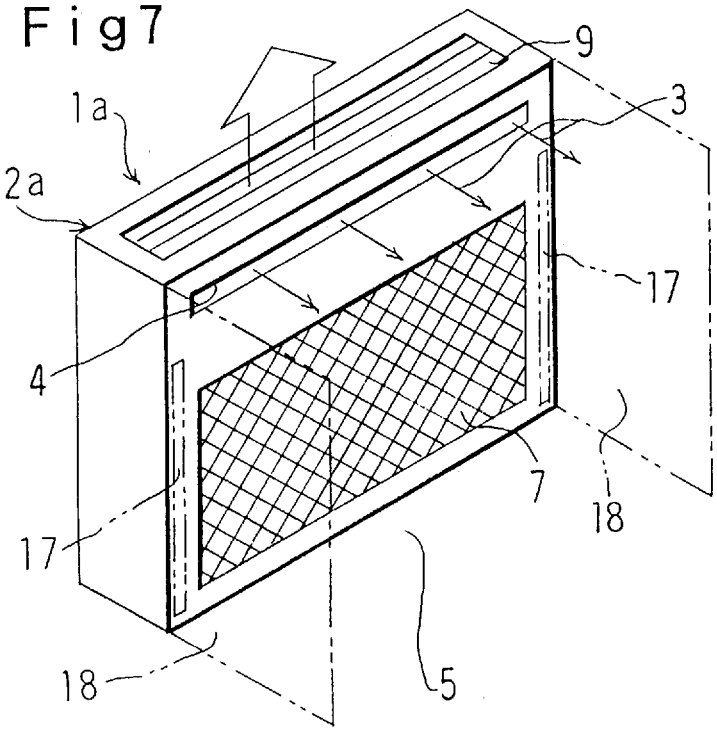
FIG. 7 is a perspective view illustrating a second embodiment of the air clear having a forced negative pressure generating function according to the present invention.
Figure 8:
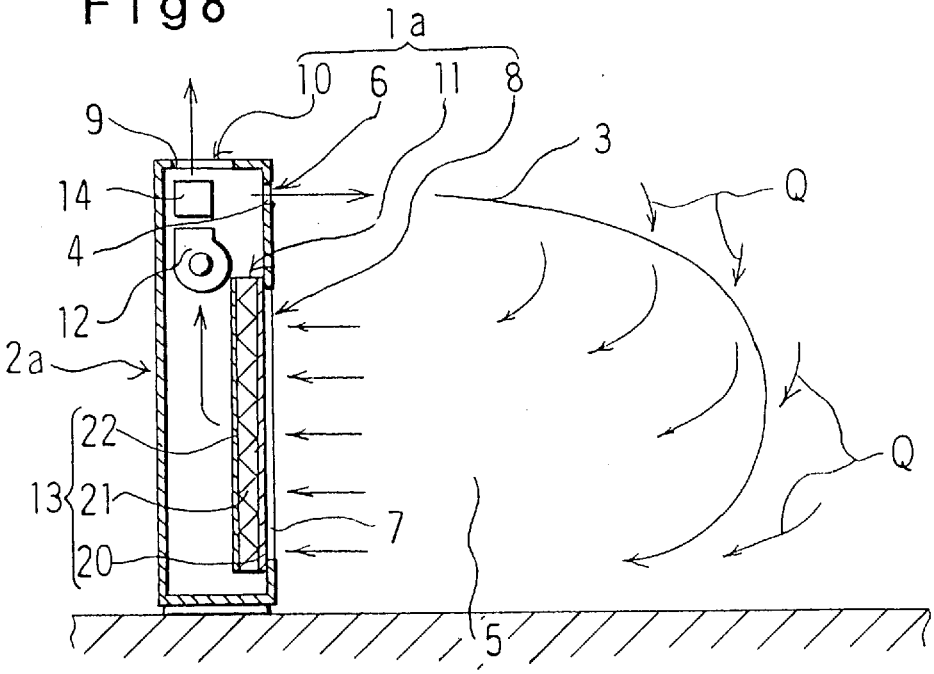
FIG. 8 is a cross-sectional view, similar to FIG. 5, of the second embodiment illustrated in FIG. 7.

FIGS. 7 and 8 illustrate a second embodiment of the present invention. The air cleaning system la having a forced negative pressure generating function according to the second embodiment differs from the first embodiment illustrated in FIGS. 4–6 in that a cleaner body 2*a* may be supported by a wall or set upright on a floor, instead of being supported by stems or suspended from the ceiling, as is the case of the first embodiment. In this way, a predetermined space 5 can be more readily formed by air curtains 3, wherein a negative pressure is produced in the predetermined space 5 in order to clean contaminated air possibly produced therein. Air blow-out ports 17 and/or side plates 18 may be provided if turbulence is expected in the air flow. Since the remaining construction and operation of the second embodiment are similar to those of the first embodiment illustrated in FIGS. 4–6, corresponding elements are designated the same reference numerals, and explanation thereon is omitted.

Figure 9:
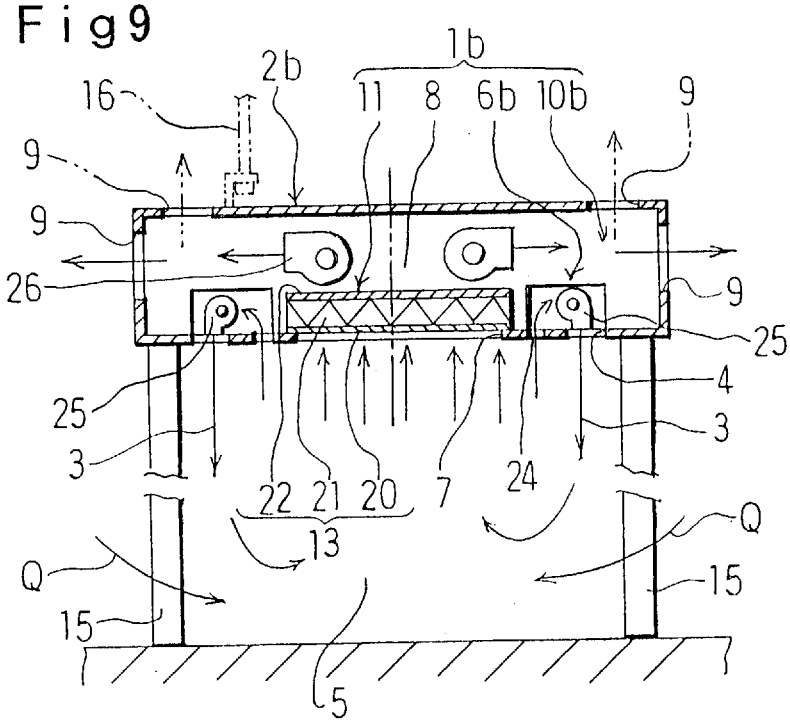
FIG. 9 is a cross-sectional view illustrating a third embodiment of the air cleaning system having a forced negative pressure generating function according to the present invention.

FIG. 9 illustrates a third embodiment of the present invention. An air cleaning system having a forced negative pressure generating function 1*c* of the third embodiment differs from the first embodiment illustrated in FIGS. 4–6 in the configuration of the air curtain producing unit and the air exhaust unit. Specifically, a clear body 2*b* is provided with a circulation suction port 24 on the downstream side of an air fan 12, instead of the air amount adjusting mechanism 14 in the first embodiment, and with an additional circulation air fan 25 between the circulation suction port 24 and the blow-out port 4. An air curtain producing unit 6*b* is configured by the circulation suction port 24 and the circulation air fan 25. Also, an air exhaust ventilator 26 is provided instead of the air fan 12 to configure an air exhaust unit 10*b*. Since the remaining construction and operation of the third embodiment are similar to those of the first embodiment illustrated in FIGS. 4–6, corresponding elements are designated the same reference numerals, and explanation thereon is omitted.

Figure 10:
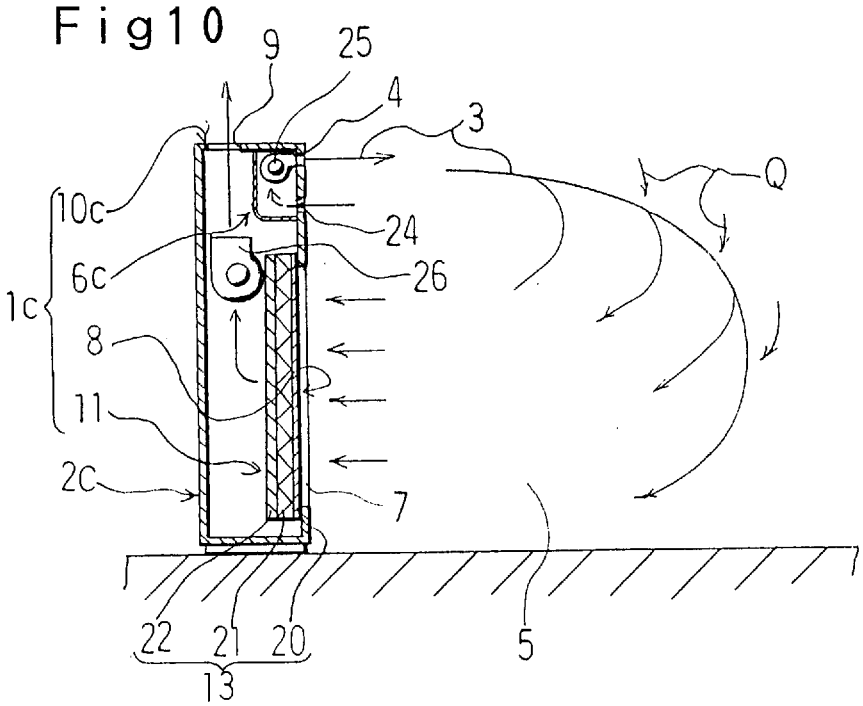
FIG. 10 is a cross-sectional view illustrating a fourth embodiment of the air cleaning system having a forced negative pressure generating function according to the present invention.

FIG. 10 illustrates a fourth embodiment of the present invention. An air cleaning system 1*c* having a forced negative pressure generating function according to the fourth embodiment differs from the second embodiment illustrated in FIGS. 7 and 8 in the configuration of the air curtain producing unit and the air exhaust unit. Specifically, a clear body 2*c* is provided with a circulation suction port 24 on the downstream side of an air fan 12, instead of the air amount adjusting mechanism 14 in the first embodiment, and with an additional circulation air fan 25 between the circulation suction port 24 and the blow-out port 4. An air curtain producing unit 6*c* is configured by the circulation suction port 24 and the circulation air fan 25. Also, an air exhaust ventilator 26 is provided instead of the air fan 12 to configure an air exhaust unit 10*b*. Since the remaining construction and operation of the fourth embodiment are similar to those of the second embodiment illustrated in FIGS. 7 and 8, corresponding elements are designated the same reference numerals, and explanation thereon is omitted.

Figure 11:
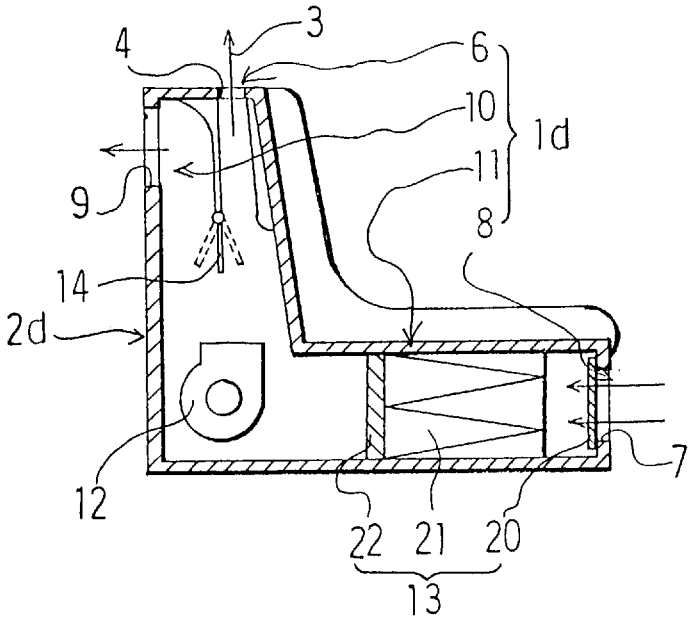
FIG. 11 is a cross-sectional view illustrating a fifth embodiment of the air cleaning system having a forced negative pressure generating function according to the present invention.
Figure 12:
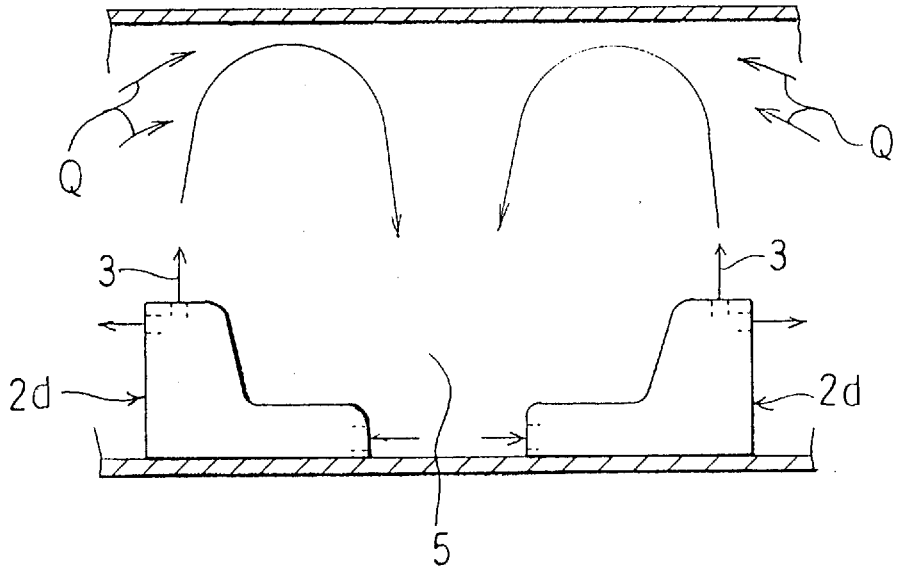
FIG. 12 is a lateral view showing how air flows in a room in which the air cleaning system of the fifth embodiment is installed.

FIGS. 11 and 12 illustrate a fifth embodiment of the present invention. An air cleaning system 1*d* having a forced negative pressure generating function according to the fifth embodiment is such that various components constituting the cleaner body 2*a* in the air cleaning system 1*a* having a forced negative pressure generating function illustrated in FIGS. 7 and 8 are incorporated in a chair 2*d*. Since the remaining construction and operation of the fifth embodiment are similar to those of the second embodiment illustrated in FIGS. 7 and 8, corresponding elements are designated the same reference numerals, and explanation thereon is omitted. It will be of course understood that the components arranged in the clear body 2*c* illustrated in FIG. 10 may be incorporated in the chair 2*d*.

Figure 13:
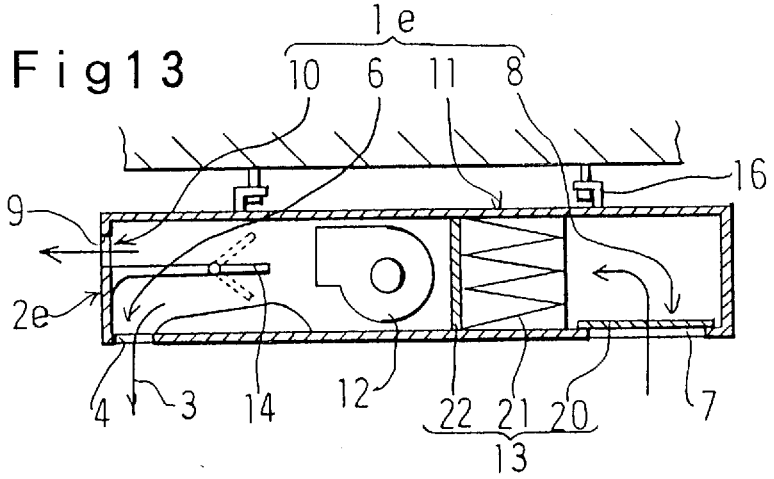
FIG. 13 is a cross-sectional view illustrating a sixth embodiment of the air cleaning system having a forced negative pressure generating function according to the present invention.
Figure 14:
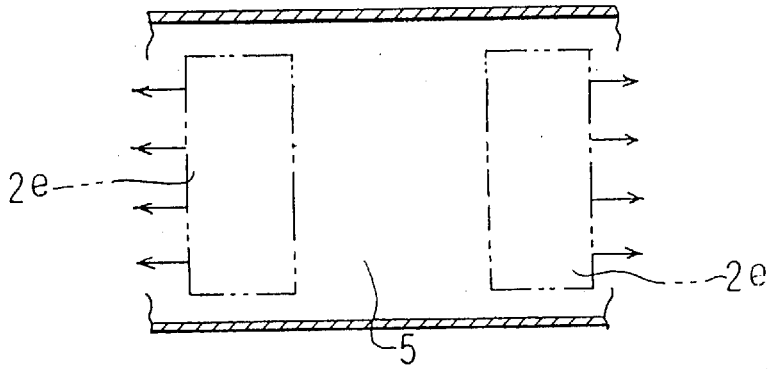
FIG. 14 is a top plan view illustrating the air cleaning system having a forced negative pressure generating function when installed in a room.
Figure 15:
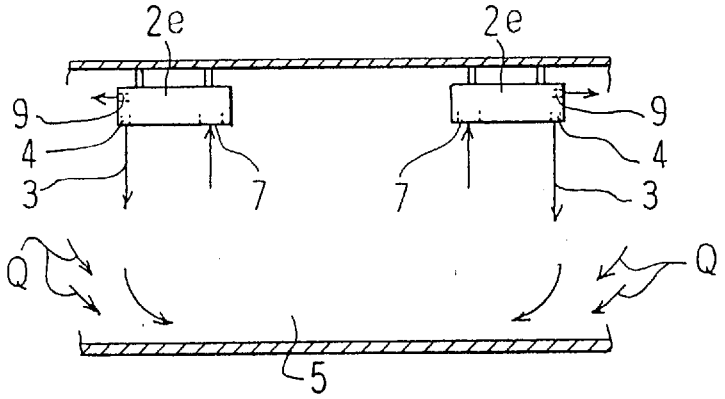
FIG. 15 is a lateral view, similar to FIG. 12, of the sixth embodiment illustrated in FIG. 13.
Figure 16:
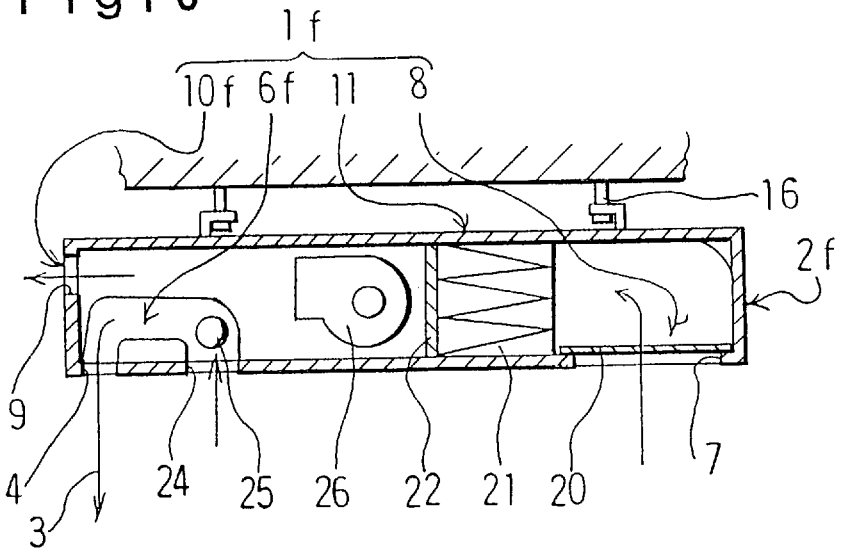
FIG. 16 is a cross-sectional view illustrating an air cleaner body forming part of an air cleaning system having a forced negative pressure generating function according to a seventh embodiment of the present invention.
Figure 17:
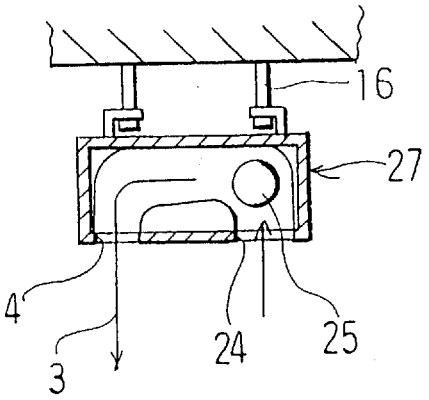
FIG. 17 is a cross-sectional view illustrating an air curtain producing body forming part of the forced negative pressure generating function according to a seventh embodiment

FIGS. 13–15 illustrate a sixth embodiment of the present invention. An air cleaning system le having a forced negative pressure generating function according to the sixth embodiment is such that the air cleaning system 1 illustrated in FIGS. 4–6 is divided into two portions. Specifically, the cleaner body 2 illustrated in FIG. 5 is divided into two separate cleaner bodies 2*e* along a two-dot chain line passing the center of the cleaner body 2, so that the cleaner bodies 2*e* may be separately installed on the ceiling of a room. Since the remaining construction and operation of the sixth embodiment are similar to those of the first embodiment illustrated in FIGS. 4–6, corresponding elements are designated the same reference numerals, and explanation thereon is, omitted. It should be noted that the cleaner body 2*e* illustrated in FIG. 13 may be replaced by a cleaner body 2*f* illustrated in FIG. 16, later described.

FIGS. 16–19 illustrate a seventh embodiment of the present invention. An air cleaning system 1*f* having a forced negative pressure generating function according to the seventh embodiment is such that the air cleaning system 1*b* illustrated in FIG. 9 is divided into two portions. Specifically, the cleaner body 2*b* of the air cleaning system 1*b* is divided along a two-dot chain line passing the center of the cleaner body 2 into a cleaner body 2*f* comprising an air exhaust ventilator 26 having a larger air amount, an air cleaner 13 having a larger air cleaning capability and an associated air exhaust port 10*f*, and an air curtain producing body 27 comprising an air curtain producing unit 6*f* composed of a circulation suction port 24 and a circulation air fan 25. The air curtain producing body 27 does not include the air exhaust ventilator 26 or the air cleaner 13. Since the remaining construction and operation of the seventh embodiment are similar to those of the third embodiment illustrated in FIG. 9, corresponding elements are designated the same reference numerals, and explanation thereon is omitted.

Figure 18:
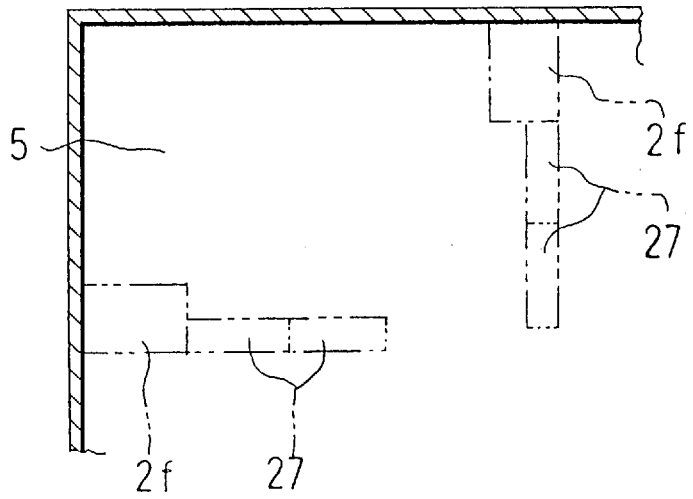
FIG. 18 is a top plan view illustrating how the air cleaner bodies and the air curtain producing bodies are positioned for defining a space in a room.
Figure 19:
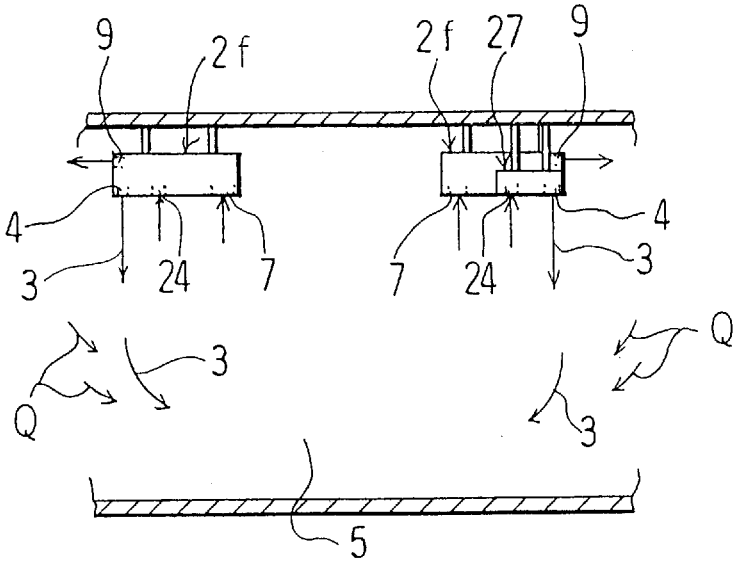
FIG. 19 is a lateral view, similar to FIG. 12, illustrating how the air cleaner bodies are installed on a ceiling.

Next, a procedure for forming a predetermined space 5 in a room by installing the air cleaner body 2*f* and the air curtain producing body 27 will be described below with reference to FIGS. 18 and 19. First, the air cleaner body 2*f* and the air curtain producing body 27 having dimensions (height, width, length) in conformity to the shape and dimension of a room are selected. Then, required numbers of the air cleaner bodies 2*f* and the air curtain producing bodies 27 are provided and positioned in the room, for example, as illustrated in FIGS. 18 and 19. The air cleaner bodies 2*f* are positioned such that all the circulation suction ports 24 and the suction ports 7 face the predetermined space 5 and the exhaust ports 9 faces the outside of the predetermined space 5. The way of surrounding the predetermined space in the room by the cleaner bodies 2*f* and the air curtain producing bodies 27 is similar to the third embodiment illustrated in FIG. 9.

Next, the respective circulation air fans 25 and air exhaust ventilators 26 are operated. The respective circulation air fans 25 in operation cause air to enter the predetermined space 5 through the circulation suction ports 24 and to exit therefrom through the blow-out port 4, thus forming air curtains 3. The air curtains 3, cleaner bodies 2*f*, and air curtain producing bodies 27 surround part of the room to define the predetermined space 5, and air circulates in the room. In this event, the air curtains 3 involve air from the outside of the predetermined space 5 (the amount of the involved air from the outside is represented by Q). Then, the air exhaust ventilators 26 each having a larger air amount and the air cleaner 13 each having a larger air cleaning capability of the cleaner bodies 2*f* exhaust air inside the predetermined space 5 through the exhaust ports 9 to place the predetermined space 5 in a negative pressure state. It will be understood that the process of producing the negative pressure state in the predetermined space 5 is similar to the third embodiment illustrated in FIG. 9.

In the seventh embodiment, since the air cleaning system if is separated into the cleaner body 2*f* incorporating the air cleaner 13 and the air curtain producing body 27 dedicated to the production of air curtain, the air cleaning system as a whole can be reduced in size. In addition, since the number of the air cleaners 13 are reduced, the maintenance of the air cleaning system is facilitated.

It should be noted that although the air cleaner bodies of the sixth and seventh embodiments in FIGS. 13–19 are each illustrated as being suspended from the ceiling of a room, they may be embedded in the ceiling.

The foregoing description of the specific embodiments will so fully reveal the general nature of the invention that others can, by applying current knowledge, readily modify and/or adapt for various applications such specific embodiments without departing from the generic concept, and therefore such adaptations and modifications should and are intended to be comprehended within the meaning and range of equivalents of the disclosed embodiments. Accordingly, the invention is intended to embrace all such alternatives, modifications, equivalents and variations as fall within the spirit and broad scope of the appended claims.

What is claimed is:

1. An air cleaning system having a forced negative pressure generating function comprising:

a body having means for supporting said body above a predetermined space;

suction means mounted in said body having a suction port for sucking air from said predetermined space;

air curtain producing means mounted in said body for receiving air from said suction means and having a blow-out port for producing air curtains surrounding said predetermined space;

air exhausting means mounted in said body for receiving air from said suction means and having an exhaust port open to the outside of said predetermined space for exhausting air;

air cleaning means interposed between said exhaust port and said suction port;

the amount of air exhausted from said exhaust port being set larger than the amount of air drawn in by said air curtains from the outside of said predetermined space thereby producing a negative pressure in said predetermined space.

2. An air cleaning system having a forced negative pressure generating function comprising:

a body having means for supporting said body above a predetermined space;

suction means mounted in said body having a suction port for sucking air from said predetermined space;

air curtain producing means mounted in said body for receiving air from said suction means and having a blow-out port for producing air curtains surrounding said predetermined space;

air exhausting means mounted in said body for receiving air from said suction means and having an exhaust port open to the outside of said predetermined space for exhausting air;

air cleaning means interposed between said exhaust port and said suction port;

said suction means comprising an air fan having a suction side connected to said suction port and a discharge side connected to said blow-out port and said exhaust port;

air amount adjusting means positioned between the discharge side of said air fan and said blow-out port and said exhaust port, and said air cleaning means is positioned between the suction side of said air fan and said suction port, the amount of air exhausted from said exhaust port being set larger than the amount of air drawn in by said air curtains outside of said predetermined space thereby producing a negative pressure in said predetermined space.

3. The air cleaning system having a forced negative pressure generating function according to claim 1 or 2 including means for changing the direction of the air exiting from said blow-out port of said air curtain producing unit.

4. The air cleaning system according to claim 1 or 2 wherein said body is supported above the floor by a plurality of spaced stems.

5. The air cleaning system having a forced negative pressure generating function according to claim 1 or 2, wherein said air cleaning means comprises a prefilter, an electric dust precipitator, and a deodorizing filter sequentially arranged in this order midway from said suction port to said exhaust port.

6. The air cleaning system having a forced negative pressure generating function according to claim 5, wherein said electric dust precipitator includes means for intermittently turning off power supply to said electric dust precipitator for a predetermined time period when the electrodes of said electric dust precipitator short-circuit, and means for generating an alarm when the short circuit occurs a predetermined number of times within a predetermined period.

7. The air cleaning system having a forced negative pressure generating function according to claim 5, wherein said electric dust precipitator includes means for decreasing the discharge voltage for a predetermined time period when the electrodes of said electric dust precipitator short-circuit, and means for generating an alarm when the short-circuit occurs a predetermined number of times within a predetermined time period.

* * * * *